US008379491B2

(12) United States Patent
Bonhoff

(10) Patent No.: US 8,379,491 B2
(45) Date of Patent: Feb. 19, 2013

(54) TIMEPIECE WITH DYNAMIC, ANALOGUE DISPLAY OF THE TIME

(76) Inventor: Hannes Bonhoff, Berlin (DE)

( * ) Notice: Subject to any disclaimer, the term of this patent is extended or adjusted under 35 U.S.C. 154(b) by 708 days.

(21) Appl. No.: 12/439,721

(22) PCT Filed: Jul. 27, 2007

(86) PCT No.: PCT/EP2007/006668

§ 371 (c)(1),
(2), (4) Date: Dec. 29, 2009

(87) PCT Pub. No.: WO2008/028539

PCT Pub. Date: Mar. 13, 2008

(65) Prior Publication Data

US 2010/0091616 A1 Apr. 15, 2010

(30) Foreign Application Priority Data

Sep. 4, 2006 (DE) ..... 10 2006 042 133

(51) Int. Cl.
*G04B 19/04* (2006.01)
*G04B 19/20* (2006.01)
*G04B 19/00* (2006.01)

(52) U.S. Cl. ..... 368/80; 368/77; 368/223; 368/233

(58) Field of Classification Search ..... 368/76, 368/77, 80, 223, 228, 233, 234
See application file for complete search history.

(56) References Cited

U.S. PATENT DOCUMENTS

| | | | | |
|---|---|---|---|---|
| 5,051,968 | A * | 9/1991 | Calabrese | 368/76 |
| 5,349,572 | A * | 9/1994 | Belik | 368/77 |
| 5,359,578 | A * | 10/1994 | Truini | 368/76 |
| 6,813,222 | B1 * | 11/2004 | De Salivet De Fouchecour | 368/77 |
| 7,061,833 | B2 * | 6/2006 | Dierenbach | 368/76 |
| 7,502,280 | B2 * | 3/2009 | Mueller | 368/77 |
| 2003/0099159 | A1 * | 5/2003 | Herbstman et al. | 368/77 |
| 2003/0210611 | A1 * | 11/2003 | Bloch | 368/77 |
| 2008/0068931 | A1 * | 3/2008 | Buttet et al. | 368/37 |
| 2008/0137487 | A1 * | 6/2008 | Buttet et al. | 368/37 |
| 2009/0154298 | A1 * | 6/2009 | Taylor et al. | 368/77 |

FOREIGN PATENT DOCUMENTS

| | | | |
|---|---|---|---|
| DE | 20 44 355 | | 3/1972 |
| DE | 3503672 | A1 | 8/1986 |
| DE | G 93 03 530.6 | U1 | 8/1993 |
| DE | 4312110 | A1 | 9/1994 |
| EP | 1003085 | A1 | 5/2000 |
| WO | 00/31594 | | 6/2000 |
| WO | 2004/010084 | A2 | 1/2004 |

* cited by examiner

*Primary Examiner* — Vit W Miska
(74) *Attorney, Agent, or Firm* — Maschoff Gilmore & Israelsen

(57) ABSTRACT

A timepiece with a dynamic, analogue display of the time. The timepiece has a first hand which rotates at a first speed and a second hand which rotates at a second speed, wherein the time is displayed with respect to a time unit when the two hands coincide in that the angular position of the coincidence indicates the current time of the time unit viewed on a dial.

34 Claims, 11 Drawing Sheets

TIMEPIECE WITH DYNAMIC, ANALOGUE DISPLAY OF THE TIME

CROSS-REFERENCE TO A RELATED APPLICATION

This application is a National Phase Patent Application of International Patent Application Number PCT/EP2007/006668, filed on Jul. 27, 2007, which claims priority of German Patent Application Number 10 2006 042 133.7, filed on Sep. 4, 2006.

BACKGROUND

This invention relates to a timepiece with a dynamic, analogue display of the time.

The analogue display of the time on a timepiece usually is effected by means of a two- or three-hand system, wherein one hand indicates the hour, one hand indicates the minute, and one possibly present third hand indicates the second. The fundamental principle of reading the time is the mental processing of the static, geometric image of the display, as it is indicated by the two or three hands of the display at a certain time.

Reading the time as the mental processing of a static, geometric image, however, contradicts the dynamic character of the time, which naturally does not stand still and is not static.

SUMMARY

Accordingly, the object underlying the invention is to provide a timepiece with a display, which conveys the dynamic character of time to the user.

In an embodiment of the invention, there is provided a timepiece, in which the time is indicated by the coincidence of at least two hands rotating at different speeds. A display of time in terms of a time unit (e.g. hour, minute or second) always is effected when a first hand coincides with a second hand. At the point of coincidence, the common position of the hands defines the current time (the time unit viewed) on a dial. Outside the times and angles of the coincidence, an appropriate reading of time is not possible.

By means of a precise adjustment of the angular velocities of the hands, it is achieved that the respective point of coincidence between two hands exactly lies on the current angular position of the corresponding time unit to be represented, e.g. hour, minute or second, of a conventional analogue timepiece. Reading the time is effected by observing the movement and the interplay of the hands.

The two hands, which upon coincidence indicate a time unit, can be referred to as time hand and reading hand. This designation in particular makes sense when a plurality of time hands and one reading hand are present, wherein the one reading hand is used for reading the time unit each indicated by the time hands.

The timepiece of the invention conveys the dynamic character of time to the user. For reading the current time, the movement of the hands must be observed, so that the respective angular position of two hands upon coincidence can be detected.

Any number of further time units can be indicated by the coincidence of further pairs of hands or further hands with already existing hands.

In one aspect, the timepiece has a third hand, which rotates at a third speed, wherein upon coincidence with the first hand or upon coincidence with the second hand, the third hand indicates the current time based on a further time unit. It can be provided, for instance, that upon coincidence with the first hand, the second hand indicates the hour and upon coincidence with the first hand or the second hand, the third hand indicates the minute.

In a further aspect, the timepiece furthermore has a fourth hand which rotates at a fourth speed, wherein upon coincidence with the first hand or upon coincidence with the second hand or upon coincidence with the third hand, the fourth hand indicates the current time based on a further time unit. It can be provided, for instance, that upon coincidence of the fourth hand with the first hand or any of the other hands, the second is indicated.

The term "hand" in accordance with the present invention should be understood in a broad sense. In particular, it is not necessary that a hand extends linearly or is formed substantially one-dimensional. In some embodiments, the hand has a disk-shaped geometric figure of any shape, or the hand is a geometric mark of any shape on a disk-shaped, geometric figure of any shape. There can be provided a disk-shaped figure which rotates centrically or eccentrically.

Corresponding to the broad understanding of the term "hand", the term "coincidence" also should be understood in a broad sense. In some embodiments it is provided that the coincidence of two hands is effected by a partial or complete superposition of the two hands, by a partial or complete framing or concealing of one hand by the other, by a coincidence of the sides of two hands, or by a combination of the above-mentioned variants.

Reference furthermore is made to the fact that it is by no means necessary that exactly one reading hand is provided, which is associated to a plurality of time hands. In some embodiments it can likewise be provided that one or more of the time hands have a separate reading hand. It can also be provided that one time hand serves as reading hand for another time hand.

Reading and time hands can run in clockwise or counterclockwise direction. Furthermore, the manner of display in accordance with the invention is basically applicable to dials of any kind. Beside the most frequently used dials with hands for hours, minutes and possibly seconds rotating in clockwise direction with circulation times of 12 hours, 60 minutes and 60 seconds, e.g. circulation times of 24 hours, left-handed scales or even weekday hands can also be realized.

The hands can be of the mechanical type or be represented as a pattern on an electronically actuatable display screen or be projected onto a projection surface.

BRIEF DESCRIPTION OF THE DRAWINGS

The invention will subsequently be explained in detail by means of several embodiments with reference to the Figures of the drawing, in which.

DETAILED DESCRIPTION

The embodiment of FIGS. 1-4 has a conventional, right-handed dial with a division into 12 hours, 60 minutes and 60 seconds. In the illustrated example, the times 12 o'clock, 3 o'clock, 6 o'clock and 9 o'clock are represented by the Roman numerals XII-III-VI-IX in a manner known per se. However, this should only be understood as an example. Any conventional dial can be used.

What is novel with the timepiece and its display are the hands used, their angular velocities and interaction. There is provided a first hand A, which extends in radial direction across the entire dial. There is provided a second hand H, which extends radially in an inner region of the display. There is provided a third hand M, which extends radially in a middle region of the display, and there is provided a fourth hand S, which extends radially around an outer region of the display. The first hand A is the reading hand, the second hand H is the hour hand, the third hand M is the minute hand, and the fourth hand S is the second hand.

The hour hand H, the minute hand M and the second hand S are formed with a straight, line-shaped black mark on concentric, circular disks. The transparent reading hand A is formed with a framing, black mark. In the coaxial arrangement, the second hand is located at the bottom, followed by the minute hand, followed by the hour hand and on top the reading hand.

Instead of disks, the hands A, H, M, S can also constitute conventional hands.

Figure 1:
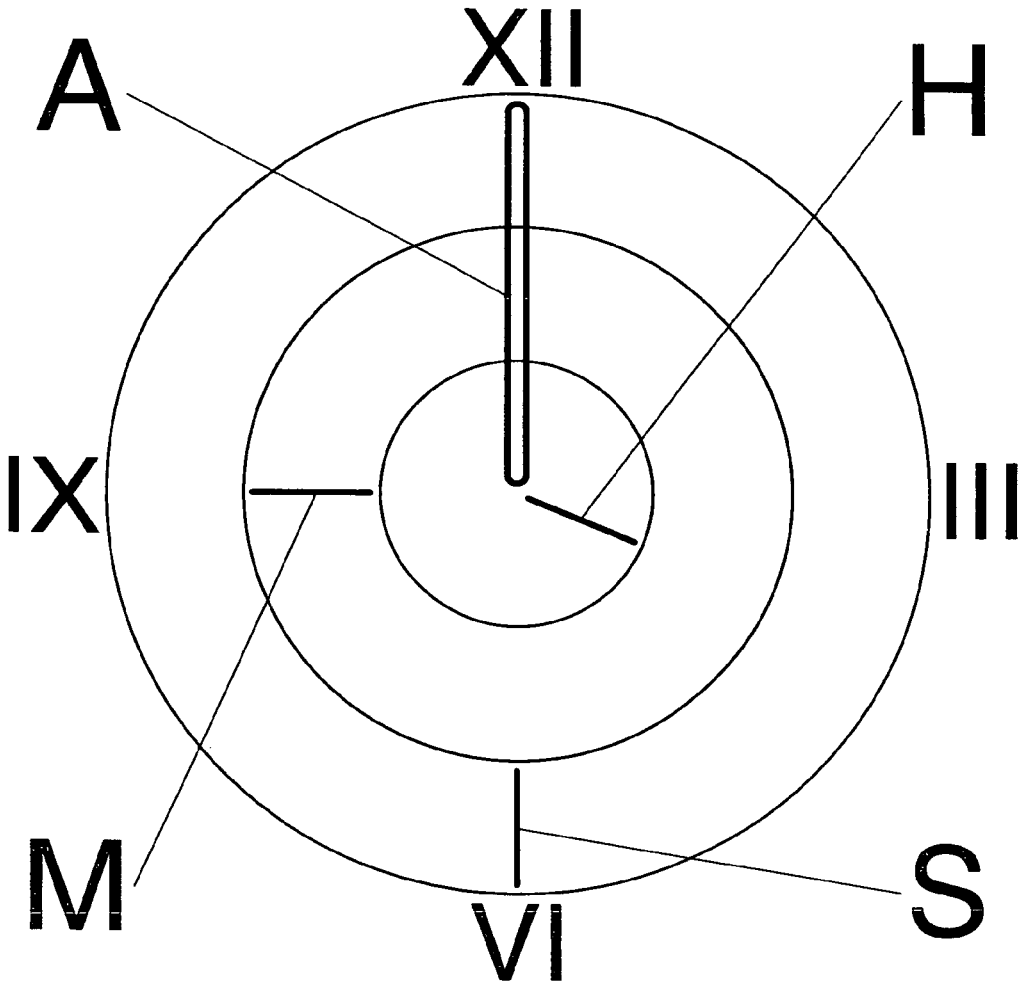
FIGS. 1-4 schematically show an embodiment of an inventive analogue timepiece display with a total of four hands, wherein in FIGS. 2 to 4 one of the hands each coincides with one of the other hands.
Figure 2:
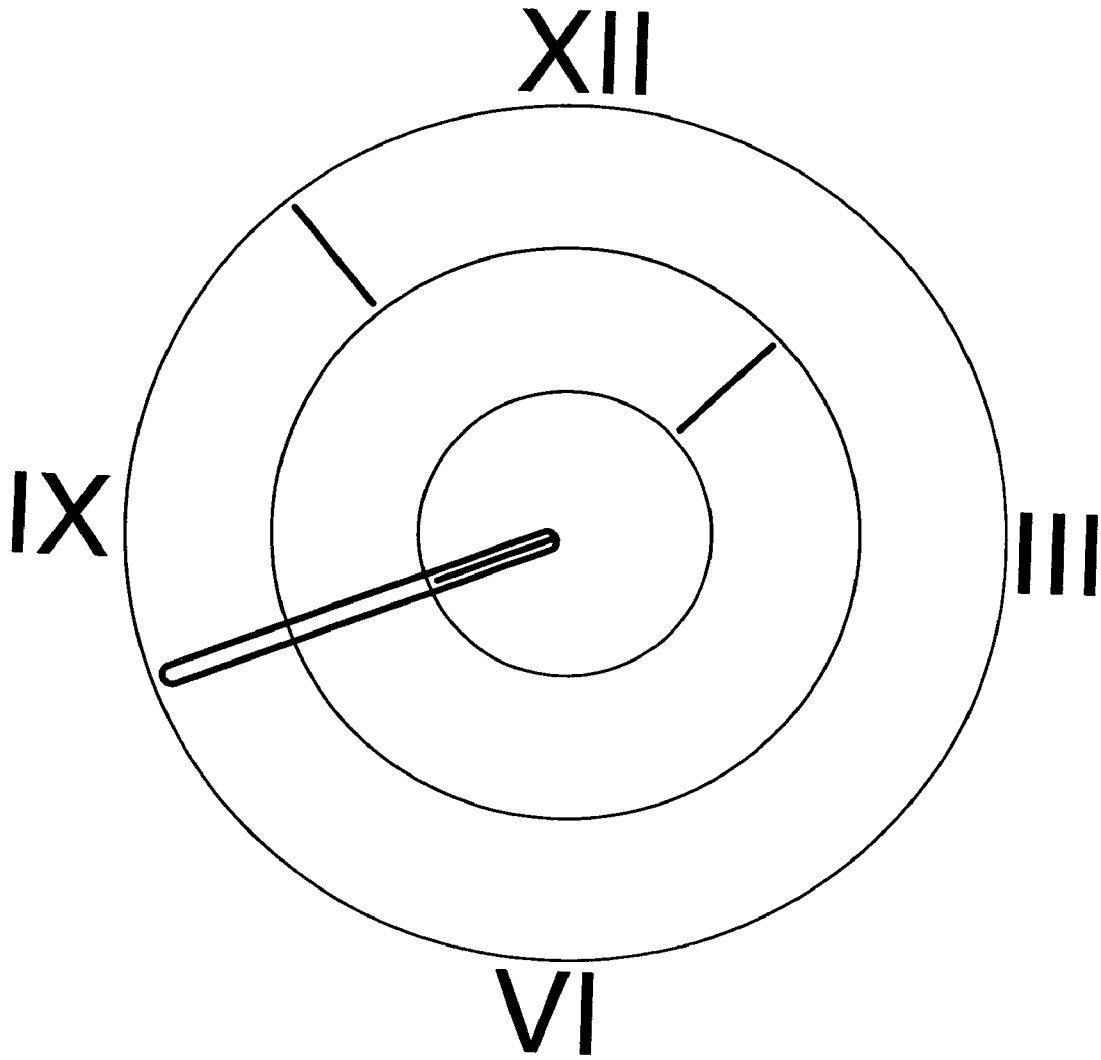
Figure 3:
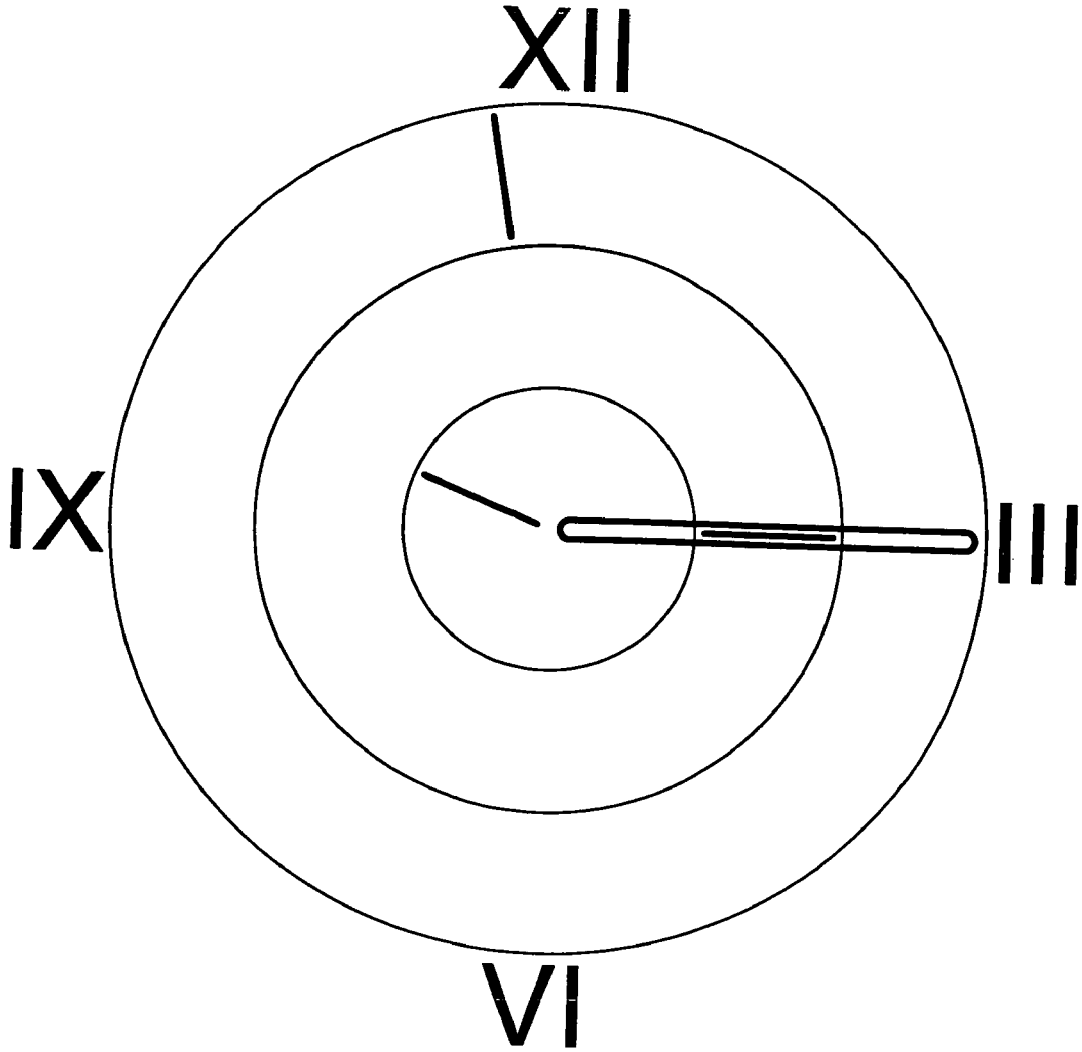

The operation of the timepiece and the time display is illustrated with reference to FIGS. 2 to 4. FIG. 2 shows the correspondence of the reading hand A with the hour hand H. It should be noted that both hands rotate at different speeds. When the two hands A, H coincide, the time can be read in terms of the current hour. It can be seen that the current hour approximately is 8 o'clock. In FIG. 3, the reading hand A coincides with the minute hand H, and again it applies that both hands A, M rotate continuously at different speeds. In the case of the coincidence of the two hands as shown in FIG. 3, the number of minutes is 15. By means of the two reading operations performed, it thus can already be determined that it is 8.15 am.

Figure 4:
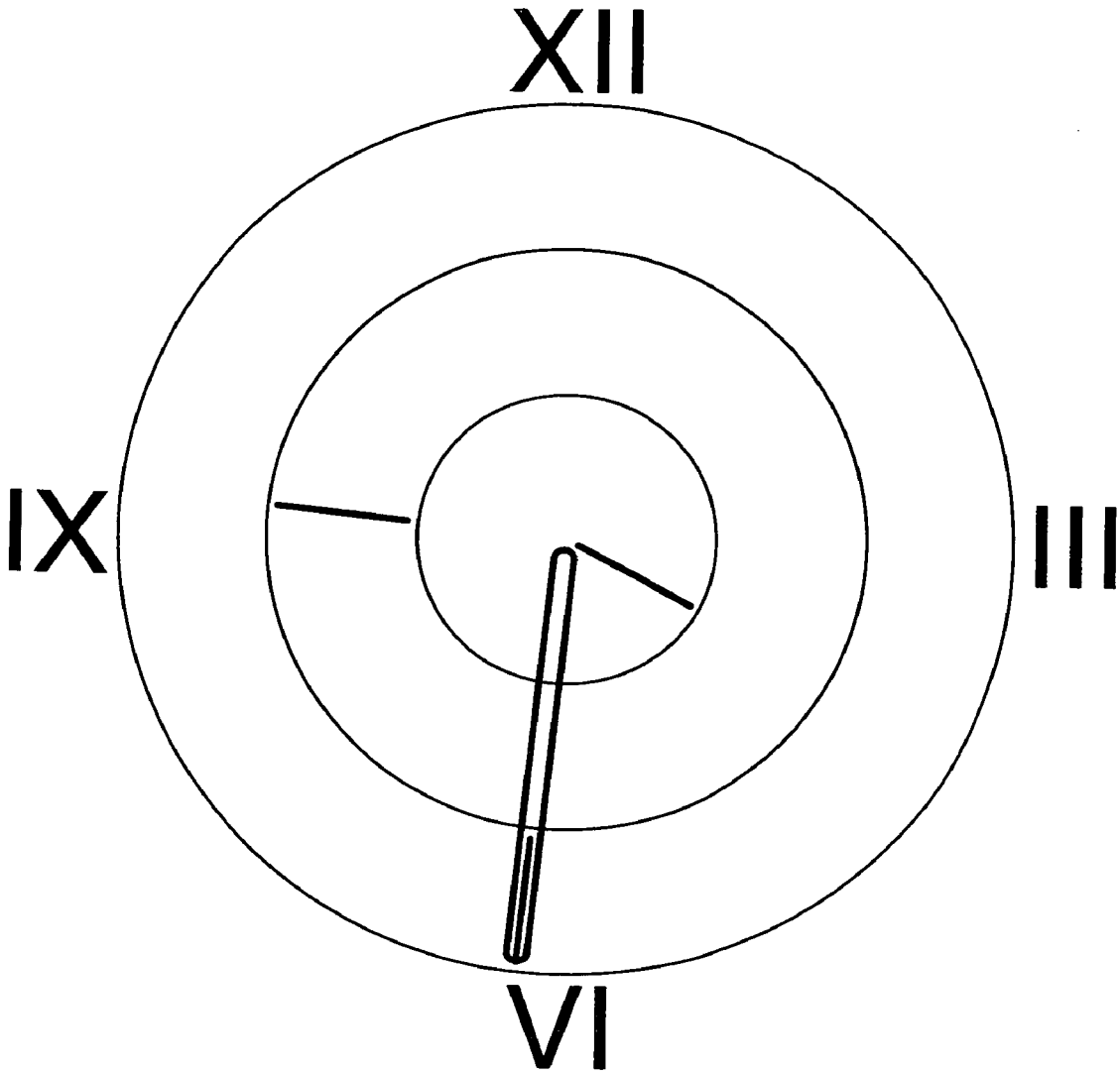

FIG. 4 shows a coincidence of the reading hand A with the second hand S, and again it applies that both hands A, S rotate at different speeds. Now, the time can accurately be detected to the second, and it should be noted that a certain time has passed already since the first reading.

To provide for such reading of the time, the angular velocities of reading hand (A) and time hands (H, M, S) each must be in a certain relation to each other. It must be ensured, for instance, that the reading hand and the minute hand only coincide at times at which the minute hand just is on a position which corresponds to the current number of minutes on the conventional dial. It should be noted that the minute hand M and also the other time hands H, S rotate at speeds which do not correspond to the conventional angular velocities of a conventional timepiece.

Preferably, it is provided that the ratio of the angular velocities of reading and time hands is given by the following formula (1).

$$\omega_1 = \frac{n+1}{n}\omega_2 - \frac{\omega_{Tk}}{n} \tag{1}$$

$\omega_1$ indicates the angular velocity of the reading hand, and $\omega_2$ indicates the angular velocity of the time hand, or vice versa. The value $\omega_{Tk}$ indicates the conventional angular velocity of the time unit viewed on a conventional timepiece, wherein k stands for conventional and T can stand e.g. for hour, minute and second. Sk thus stands for the conventional angular velocity of the second hand of a conventional timepiece, Mk for that of the minute and Hk for that of the hour.

The conventional angular velocities $\omega_{Sk}$, $\omega_{Mk}$ and $\omega_{Hk}$ for the conventional second, minute and hour hands with a clockwise direction of rotation (and hence in a mathematically negative sense of rotation) are as follows:

$$\omega_{Sk} = -\frac{2\pi}{60}\frac{\text{rad}}{\text{s}} \approx -0.10472\frac{\text{rad}}{\text{s}}$$

$$\omega_{Mk} = -\frac{2\pi}{60\cdot 60}\frac{\text{rad}}{\text{s}} = -\frac{2\pi}{3600}\frac{\text{rad}}{\text{s}} \approx -0.00175\frac{\text{rad}}{\text{s}}$$

$$\omega_{Hk} = -\frac{2\pi}{12\cdot 60\cdot 60}\frac{\text{rad}}{\text{s}} = -\frac{2\pi}{43200}\frac{\text{rad}}{\text{s}} \approx -0.00015\frac{\text{rad}}{\text{s}}$$

In the above formula (1), n furthermore can be any natural number $\geqq 1$, and it must apply that $|\omega_2|$ is greater than $|\omega_{Tk}|$.

With increasing n, the angular velocities of time hand and reading hand are approaching each other. The number n approximately (i.e. apart from the term $\omega_{Tk}/n$ of equation (1)) indicates the number of revolutions of the hand with $\omega_2$, in which the hand with $\omega_1$ once goes round the hand with $\omega_2$.

Two examples are given to explain formula (1), wherein the SI unit of the angular velocity first will briefly be discussed. In the International System of Units (SI), the unit of the angular velocity is defined as radian per second (rad/s). 2πrad correspond to one revolution, i.e. 360°. For the angular velocity, it furthermore applies: $\omega=2\pi f=2\pi/T$, wherein T is the circulation time and f is the frequency.

In a first example, the reading hand A, the hour hand H and the minute hand M are observed. The angular velocities for these hands are $\omega_A$, $\omega_H$ and $\omega_M$.

With the above formula (1), and with n=1 and a chosen angular velocity of the reading hand of $\omega_A=\pi$rad/s (i.e. ½ counterclockwise revolution per second) the following is obtained for the angular velocities $\omega_H$ and $\omega_M$ of hour hand and minute hand:

$$\omega_H = 2\omega_A - \omega_{Hk} = 2\pi\frac{\text{rad}}{\text{s}} + \frac{2\pi}{12\cdot 60\cdot 60}\frac{\text{rad}}{\text{s}} \approx 6.28333\frac{\text{rad}}{\text{s}}$$

$$\omega_M = 2\omega_A - \omega_{Mk} = 2\pi\frac{\text{rad}}{2} + \frac{2\pi}{60\cdot 60}\frac{\text{rad}}{\text{s}} \approx 6.28493\frac{\text{rad}}{\text{s}}$$

Both the hour hand and the minute hand thus rotate a bit faster than twice as fast as the common reading hand. It should be noted that $\omega_{Hk}$ and $\omega_{Mk}$ as angular velocities of conventional time hands in clockwise direction, hence are running in a mathematically negative sense and therefore are negative. Alternatively, a reading hand running faster could also be chosen.

A second example has a look at a timepiece with hour and minute hands of the angular velocities $\omega_H$ and $\omega_M$. The hour hand has associated thereto a slower running reading hand with $\omega_A=\pi$rad/s (i.e. ½ revolution per second in counterclockwise direction). n is equal to 1. In this example, the hour hand acts as reading hand for the minute hand, wherein $\omega_H$ is greater than $\omega_M$. Then:

$$\omega_H = 2\omega_A - \omega_{Hk} = 2\pi\frac{\text{rad}}{\text{s}} + \frac{2\pi}{12\cdot 60\cdot 60}\frac{\text{rad}}{\text{s}} \approx 6.28333\frac{\text{rad}}{\text{s}}$$

$$\omega_M = \frac{\omega_H}{2} + \frac{\omega_{Mk}}{2} = \left(\pi + \frac{\pi}{12\cdot 60\cdot 60}\right)\frac{\text{rad}}{\text{s}} - \frac{\pi}{60\cdot 60}\frac{\text{rad}}{\text{s}} \approx 3.14079\frac{\text{rad}}{\text{s}}$$

In the second equation, the angular velocity of the reading hand $\omega_A$ no longer appears, since the hour hand serves as reading hand for the minute hand. In the second equation, $\omega_1$ was set equal to $\omega_H$ in the above formula (1), and the formula was solved in terms of $\omega_2$ (here $\omega_M$).

The second example is an example for the fact that the above formula (1) can be applied in different ways, e.g. when a time hand also acts as reading hand for another time hand. When the above formula is applied for the first time, the angular velocity of the first time hand will be calculated. During the second application of the formula, this angular velocity then is set as angular velocity of the reading hand and hence the angular velocity of the second time hand is calculated, wherein the first time hand serves as reading hand for the second time hand.

One possible technical implementation of the timepiece of the invention is realized as follows. The four hands A, H, M, S of the embodiment of FIGS. 1 to 4 are put onto the timepiece shafts of a clockwork one after the other. The drive of the four timepiece shafts is effected via four step motors, which are actuated electronically. The electronic control is programmed with the above formula (1) such that upon coincidence with the reading hand A, the time hands H, M, S indicate the current angular positions of the corresponding time units hour, minute and second.

A further implementation of the timepiece of the invention can be effected digitally. For this purpose, the hands are generated on a computer by a corresponding graphics program and rotated according to the above formula (1). The animation produced thus can be displayed on a screen or be projected onto a projection surface.

Figure 5:
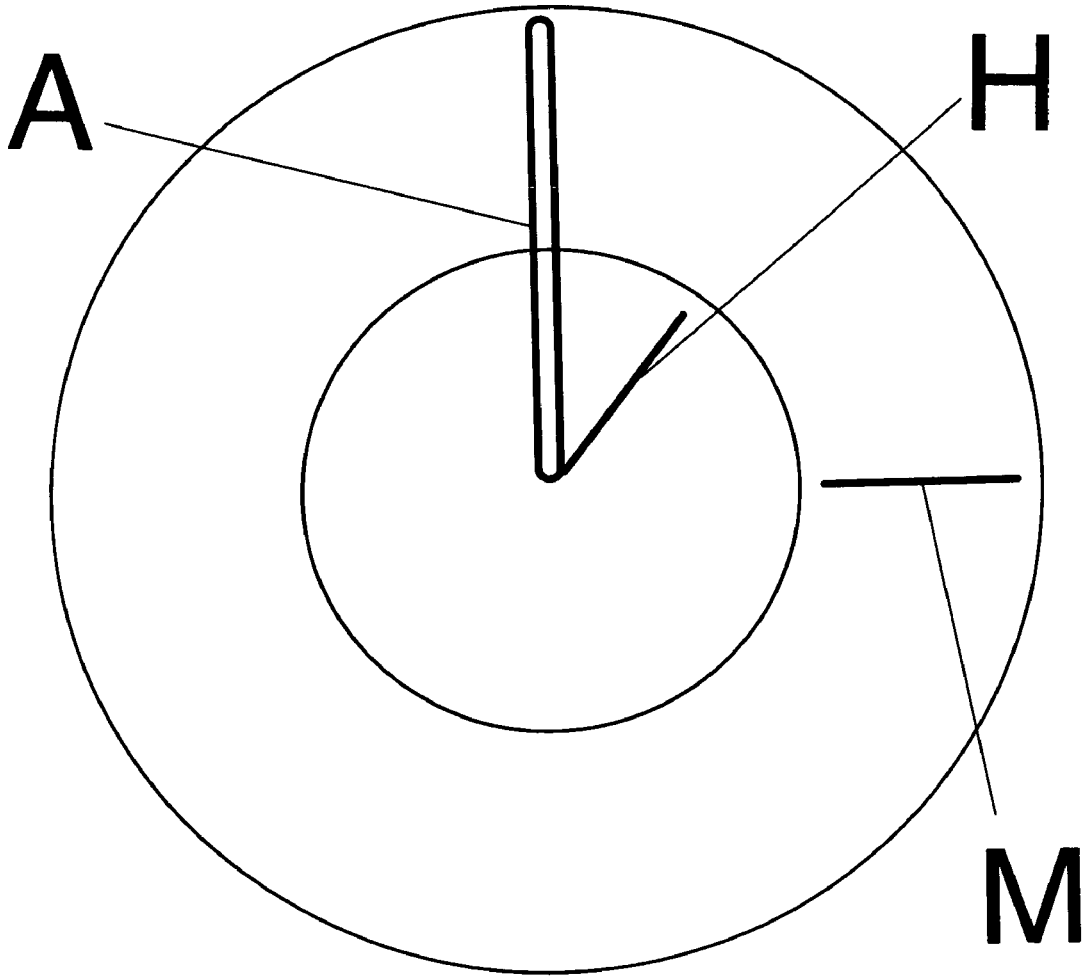
FIGS. 5-7 schematically show an embodiment of an inventive analogue timepiece display with a total of three hands, wherein in FIGS. 6 and 7 one of the hands each coincides with one of the other hands.
Figure 6:
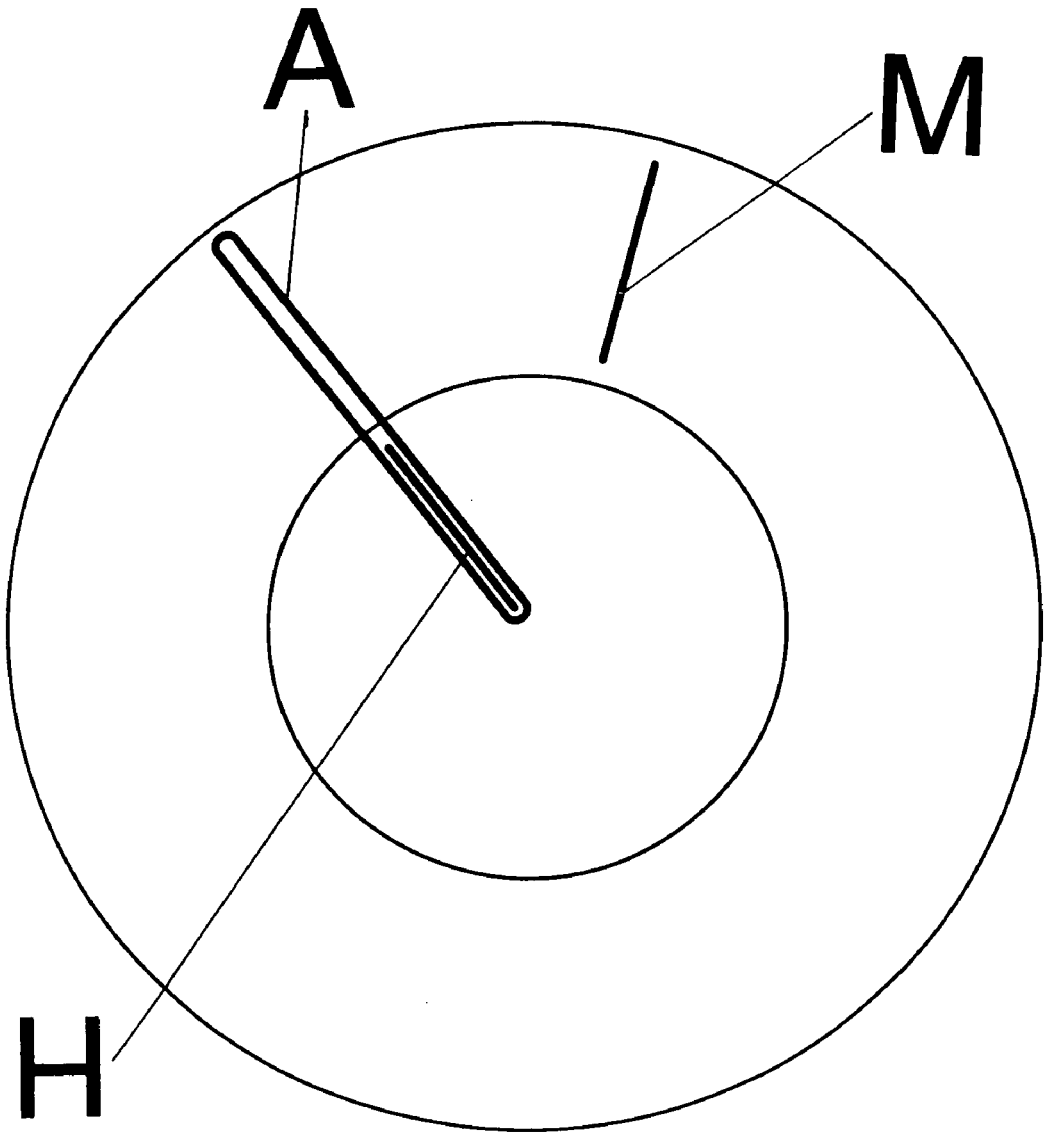
Figure 7:
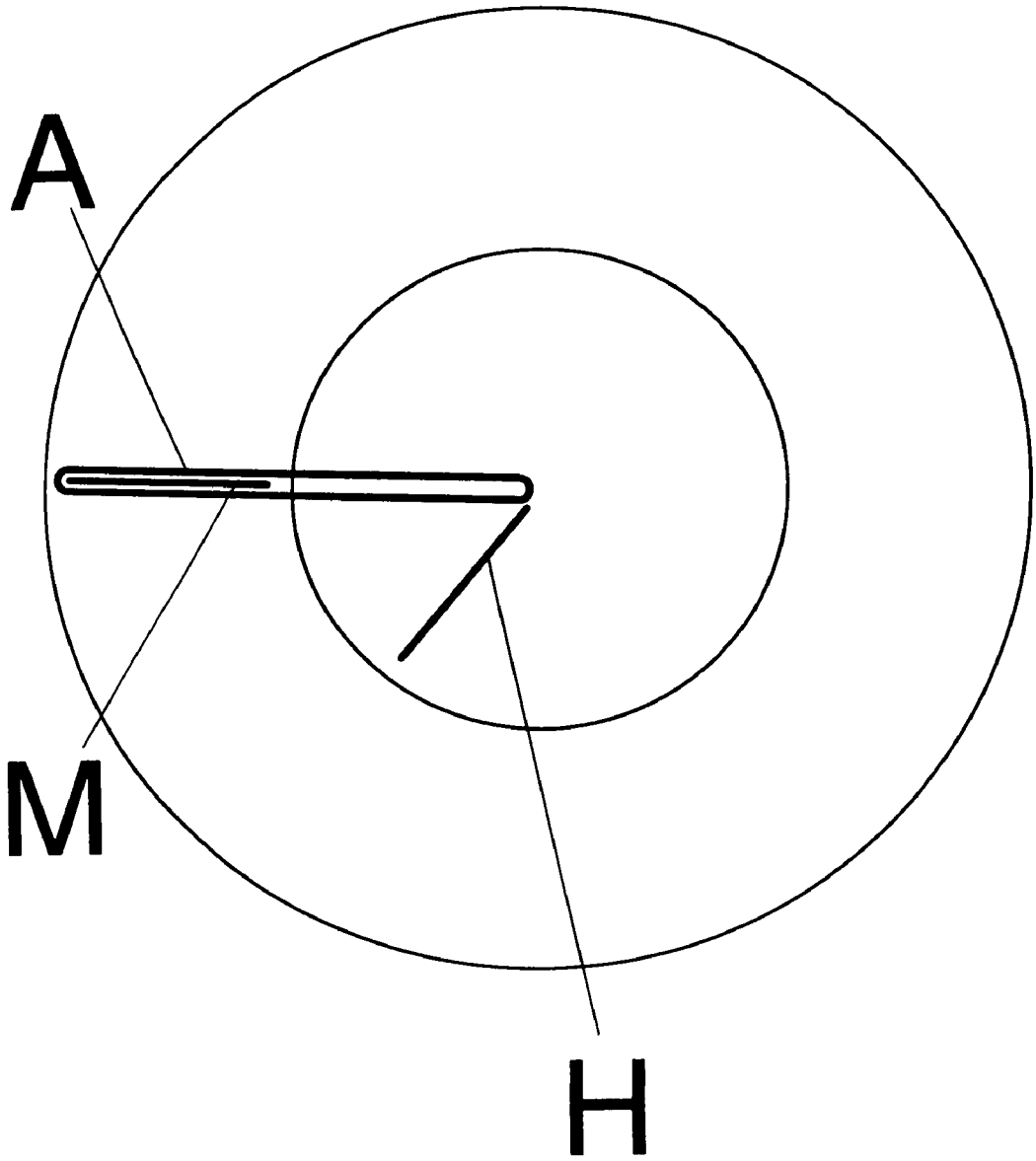

FIGS. 5 to 7 show a further embodiment, but this time only one minute hand M and one hour hand H as well as the reading hand A are provided. In principle, there are no changes with respect to the embodiment described with reference to FIGS. 1 to 4. FIGS. 6 and 7 together indicate the time 10.45 am.

Figure 8:
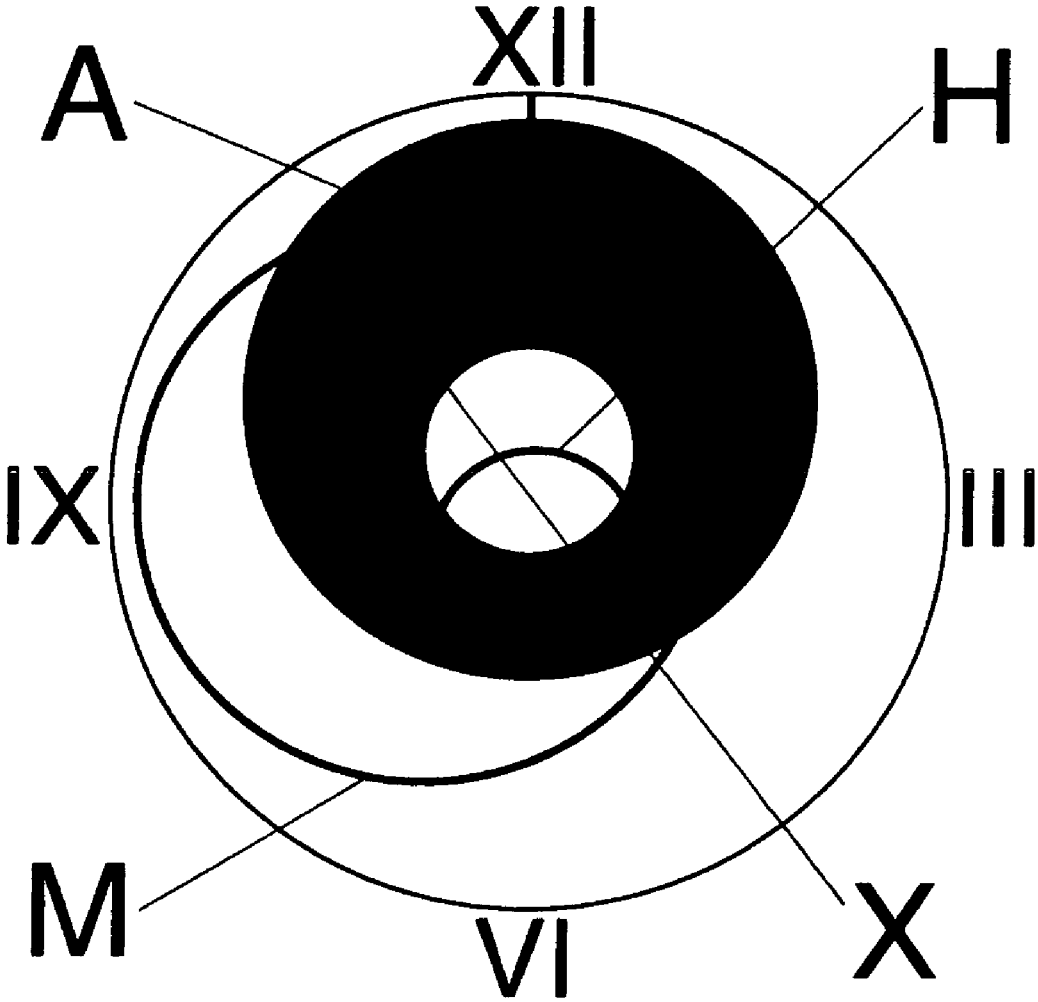
FIGS. 8-10 schematically show an embodiment of an inventive analogue timepiece display with three circular hands.
Figure 9:
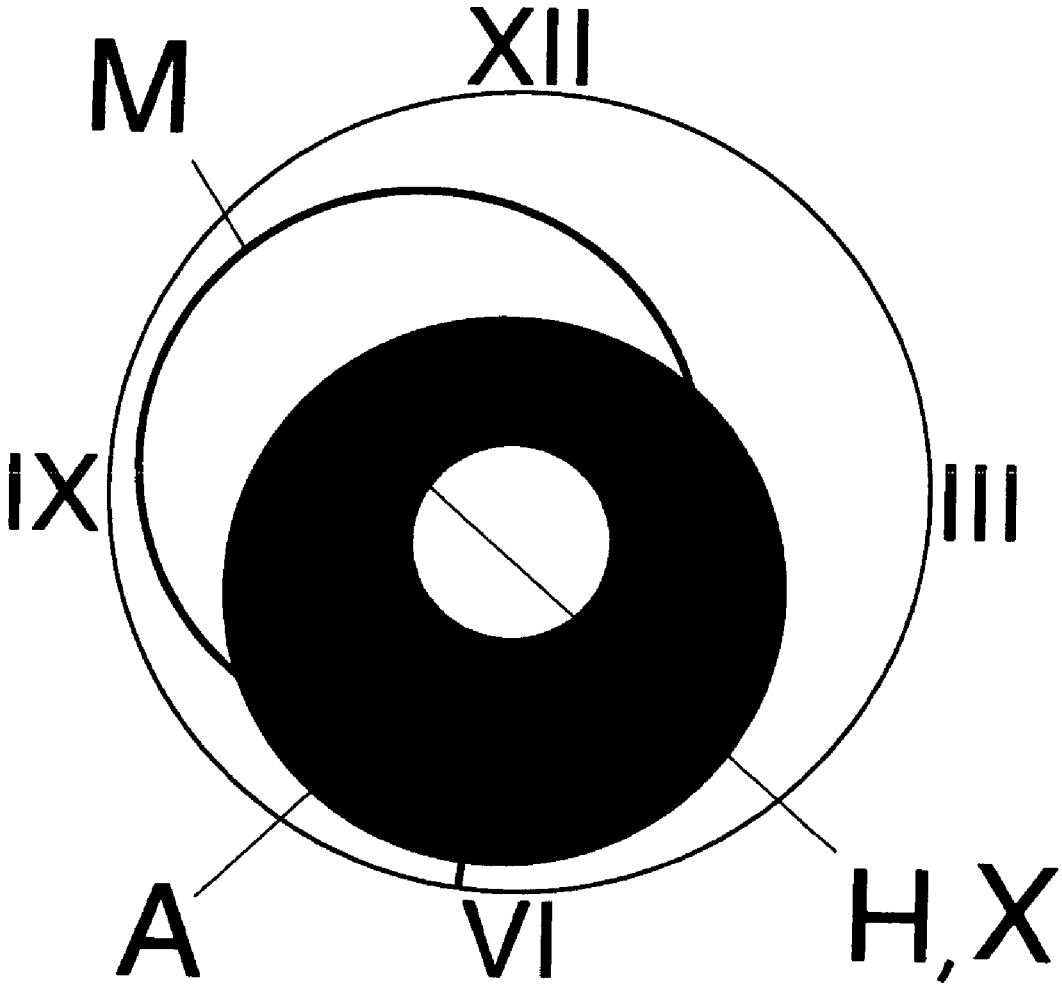
Figure 10:
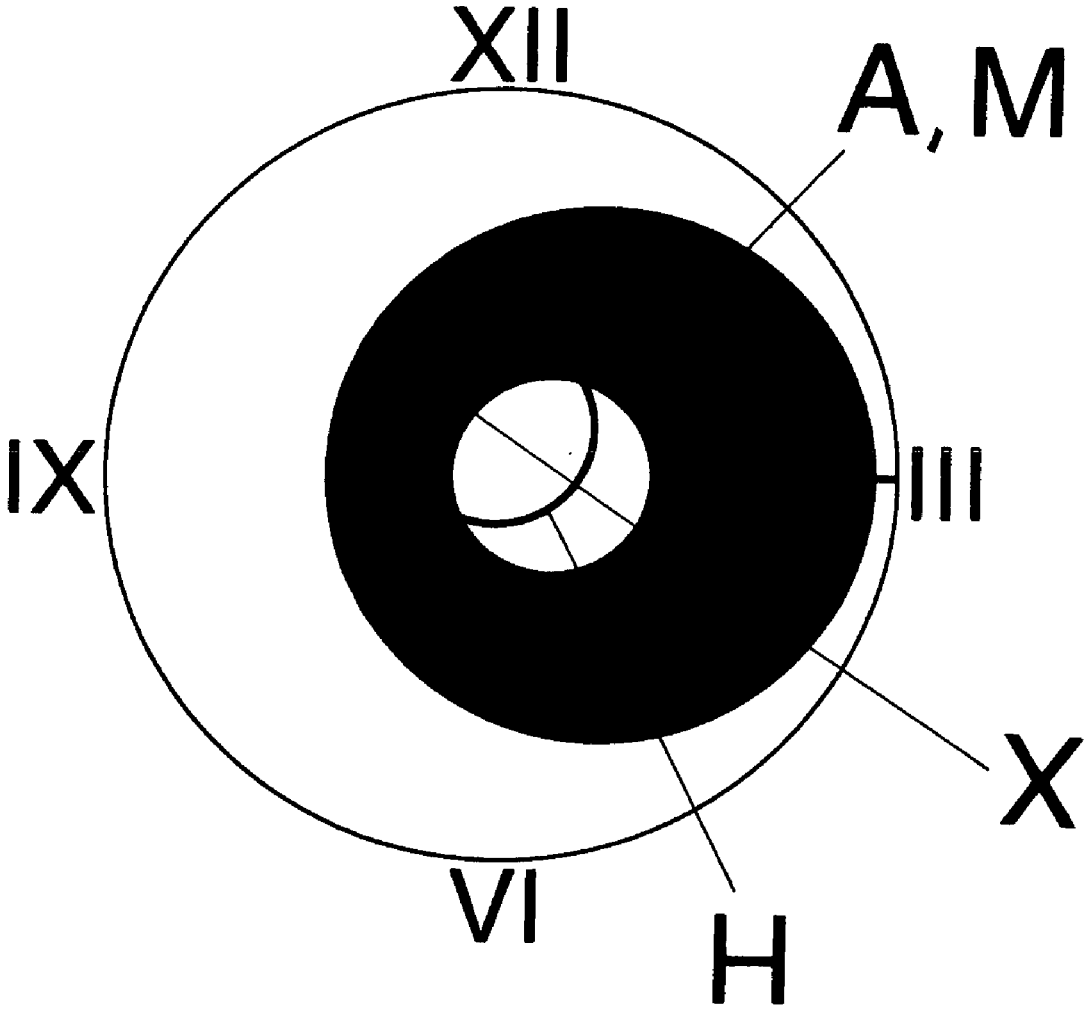

FIGS. 8 to 10 show an analogue timepiece with three hands, which each are realized by a circular disk. The hands A, H, M rotate about a common axis, which is positioned centrally with respect to the dial. The common axis of rotation each lies outside the center of the respective disk A, H, M.

One of the disks A serves as reading hand, the two other disks H, M serve as hour hand and minute hand. The reading hand consists of the circular disk A, which eccentrically has a circular recess X. The circular disk A has a diameter d1, and the circular recess X has a diameter d2, wherein it naturally applies that d2 is smaller than d1.

The minute hand consists of the circular disk M, which has the diameter d1. The hour hand consists of the circular disk H, which has the diameter d2. The minute hand M, the hour hand H and the reading hand A are arranged one above the other.

FIG. 9 shows a reading situation, in which the reading hand and the minute hand coincide in the sense that the two circular disks A, M overlap each other in terms of their outside dimensions. There is indicated the number of minutes 15.

FIG. 10 shows a reading situation, in which the reading hand and the hour hand coincide in so far as the inner recess X of the reading hand frames the circular disk H. The hour-exact time of 6 o'clock is indicated, and together with the display of FIG. 9 a time of 6.15 a.m. is obtained.

In an alternative aspect of this embodiment, it can be provided that the reading hand A is divided into two reading hands, wherein one disk forms a first reading hand corresponding to the outer circumference of the disk A, and a disk corresponding to the size of the recess X forms a second reading hand. In this variant, a reading hand is associated to each time hand M, H. For instance, both reading hands are transparent and the respective outer circumference is represented by a colored ring.

The embodiment of FIGS. 8 to 10 is an example for the fact that the reading hand and the time hands need not necessarily constitute conventional hands, but can have any disk-shaped geometric figure or can constitute any geometric mark on a disk-shaped geometric figure.

Figure 11:
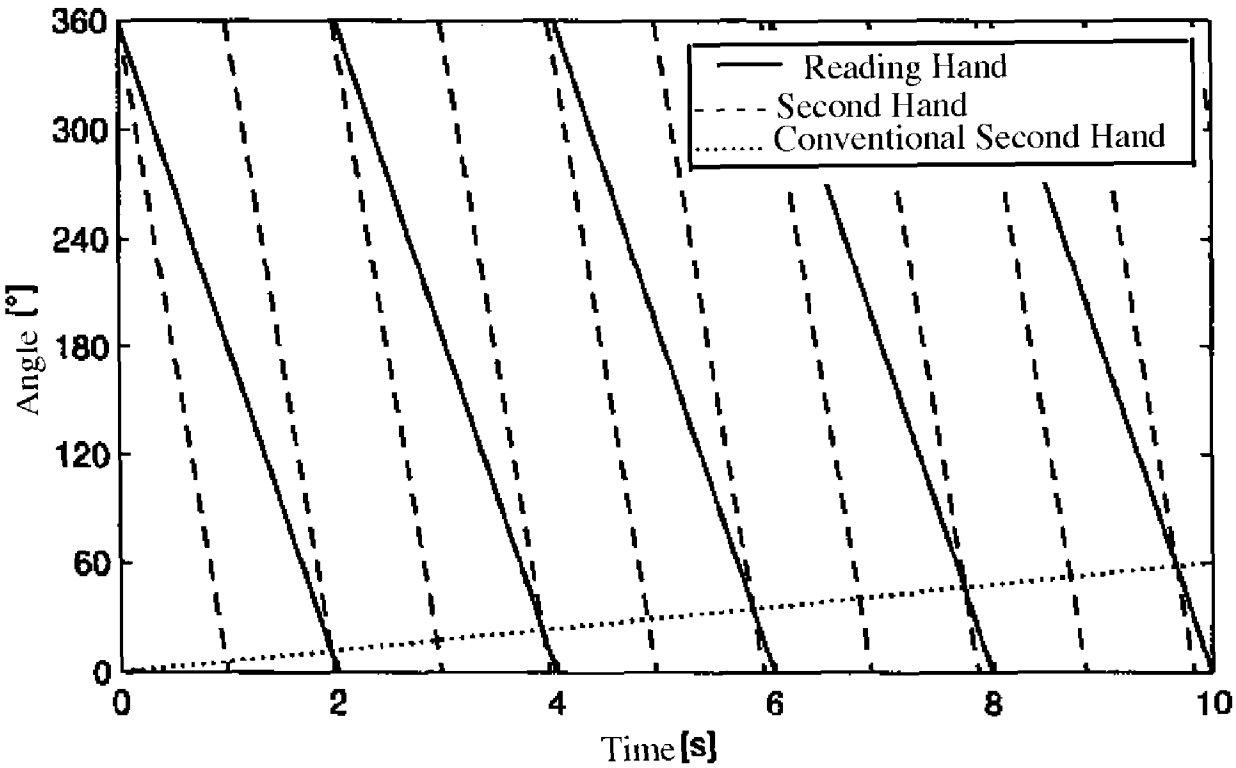
FIG. 11 shows the angles covered by a reading hand, a second hand and a conventional second hand in dependence on the time in a diagram.

In FIG. 11, the angles covered by the respective hands are illustrated in dependence on time. The angles covered are exemplary for an inventive reading hand, an inventive second hand and a conventional second hand. For a better understanding, there is first observed the sector covered by a conventional second hand, which rotates in clockwise direction. At the time zero, the angle covered naturally is zero. Within 60 seconds, a conventional second hand covers a sector of 360°. This means that within the illustrated time of 10 seconds, it covers one sixth of the sector of 360°, i.e. covers a sector of 60°. This is represented by the dotted line.

The reading hand of the invention (continuous line) rotates much faster, i.e. it covers the sector of 360° within two seconds. It rotates in counterclockwise direction. The second hand rotates even faster in counterclockwise direction and covers the sector of 360° within slightly less than one second. Reading hand and second hand overlap each other on angular positions which correspond with the angular position of the conventional second hand. The points of intersection of reading hand and second hand correspondingly lie on the straight line of the conventional second hand.

The time diagrams for e.g. hour hand and minute hand can be formed correspondingly.

The invention claimed is:

1. A timepiece with dynamic, analogue display of the time, comprising:

a first hand rotating at a first speed, and a second hand rotating at a second speed, wherein both hands rotate about the same axis; and a display of time in terms of a time unit is only effected when the two hands coincide, in that the angular position of the coincidence indicates the current time of the time unit viewed on a dial, while outside the times and angles of the coincidence of the hands an appropriate reading of time is not possible.

2. The timepiece according to claim 1, wherein any number of further time units are displayed by the coincidence of further pairs of hands or further hands with already existing hands.

3. The timepiece according to claim 1, further comprising a third hand which rotates at a third speed, wherein the third hand indicates the current time based on a further time unit, when it coincides with the first hand or when it coincides with the second hand.

4. The timepiece according to claim 3, wherein the second hand indicates the hour when it coincides with the first hand, and the third hand indicates the minute when it coincides with the first hand or with the second hand.

5. The timepiece according to claim 3, wherein the timepiece has a fourth hand which rotates at a fourth speed, wherein the fourth hand indicates the current time based on a further time unit, when it coincides with the first hand or when it coincides with the second hand or when it coincides with the third hand.

6. The timepiece according to claim 5, wherein upon coincidence of the fourth hand with the first hand or one of the other hands the second is indicated.

7. The timepiece according to claim 1, wherein the time unit viewed, at which the time is indicated when two hands coincide, is the hour, the minute or the second.

8. The timepiece according to claim 1, wherein at least one of the hands is a reading hand and at least one further hand is a time hand.

9. The timepiece according to claim 8, wherein at least three hands are provided, of which exactly one is a reading hand, and the reading hand coincides with each time hand to indicate the time in terms of a time unit.

10. The timepiece according to claim 8, wherein at least three hands are provided, wherein one or more time hands each have a separate reading hand.

11. The timepiece according to claim 8, wherein a time hand serves as reading hand for another time hand.

12. The timepiece according to claim 8, wherein at least one reading hand runs in clockwise or counterclockwise direction.

13. The timepiece according to claim 1, wherein the angular velocities of two hands, which provide a display of time in terms of a time unit, satisfy the following formula:

$$\omega_1 = \frac{n+1}{n}\omega_2 - \frac{\omega_{Tk}}{n},$$

wherein $\omega_1$ indicates the angular velocity of the one hand, and $\omega_2$ indicates the angular velocity of the other hand, or vice versa, the value $\omega_{Tk}$ indicates the conventional angular velocity of the time unit viewed, n is any natural number $\geqq 1$, and it applies that the amount of $\omega_2$ is greater than the amount of $\omega_{Tk}$.

14. The timepiece according to claim 1, wherein the coincidence of the one hand with a further hand is effected:

a) by partial or complete overlapping of the two hands, b) by partial or complete framing of one hand by the other hand, c) by a coincidence of the sides of two hands, or d) by a combination of the three variants mentioned above.

15. The timepiece according to claim 1, wherein a scale of the dial corresponds to that of a conventional, right-handed timepiece with a scale with 12 hours and 60 minutes or with 12 hours, 60 minutes and 60 seconds.

16. The timepiece according to claim 1, wherein the scale of the dial corresponds to that of a conventional, analogue timepiece with any time units, circulation times and directions of rotation.

17. The timepiece according to claim 1, wherein at least one hand has a disk-shaped geometric figure of circular shape.

18. The timepiece according to claim 1, wherein at least one hand is a geometric mark or recess of circular a shape or a disk-shaped, geometric figure of circular shape.

19. The timepiece according to claim 17, wherein the disk-shaped figure rotates eccentrically.

20. The timepiece according to claim 17, wherein the disk-shaped figure rotates centrically.

21. The timepiece according to claim 17, wherein at least one hand constitutes a circular disk.

22. The timepiece according to claim 17, wherein at least one hand constitutes a circular recess in a disk-shaped, geometric figure.

23. The timepiece according to claim 22, wherein the reading hand constitutes a circular disk with a circular recess.

24. The timepiece according to claim 23, wherein at least one time hand constitutes a circular disk whose diameter is equal to the diameter of the circular disk of the reading hand or equal to the diameter of the circular recess of the reading hand.

25. The timepiece according to claim 1, wherein at least one of the hands is formed like a conventional watch hand.

26. The timepiece according to claim 1, wherein the coincidence of two hands is effected by a precise framing or concealing of one of the hands by the other hand.

27. The timepiece according to claim 1, wherein the first hand reproduces a geometric mark or figure of at least one further hand by a corresponding mark, shape or recess on an otherwise transparent, concentric or eccentric disk of any geometry, and the coincidence of the hands is effected by a precise framing or concealing of one of the hands.

28. The timepiece according to claim 1, wherein at least one of the hands has an additional geometric mark, recess or shape towards the edge, which increases the reading accuracy.

29. The timepiece according to claim 1, wherein the hands are of the mechanical type.

30. The timepiece according to claim 1, wherein the hands are represented as pattern on an electronically actuatable display screen or are projected onto a projection surface.

31. The timepiece according to claim 18, wherein the disk-shaped figure rotates eccentrically.

32. The timepiece according to claim 18, wherein the disk-shaped figure rotates centrically.

33. A timepiece with dynamic, analogue display of the time, comprising:

a first hand rotating at a first speed, and a second hand rotating at a second speed, wherein both hands coincide periodically and a display of time in terms of a time unit is effected only when the two hands coincide, in that the angular position of the coincidence indicates the current time of the time unit viewed on a dial, while outside the times and angles of the coincidence of the hands an appropriate reading of time is not possible.

34. A timepiece with dynamic, analogue display of the time, comprising:

means for rotating at a first speed, and means for rotating at a second speed, wherein both means coincide periodically and a display of time in terms of a time unit is effected only when the two means coincide, in that the angular position of the coincidence indicates the current time of the time unit viewed on a dial, while outside the times and angles of the coincidence of the two means an appropriate reading of time is not possible.

* * * * *

UNITED STATES PATENT AND TRADEMARK OFFICE

CERTIFICATE OF CORRECTION

PATENT NO. : 8,379,491 B2
APPLICATION NO. : 12/439721
DATED : February 19, 2013
INVENTOR(S) : Hannes Bonhoff It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1009 days.

Signed and Sealed this
First Day of September, 2015

Michelle K. Lee

Michelle K. Lee
*Director of the United States Patent and Trademark Office*